US005947562A

United States Patent [19]

Christofferson et al.

[11] Patent Number: 5,947,562

[45] Date of Patent: Sep. 7, 1999

[54] QUICK RELEASE SEAT

[75] Inventors: James L. Christofferson, Longmont; Grant C. Denton; Peter A. Swisshelm, both of Boulder, all of Colo.

[73] Assignee: Sunrise Medical HHG Inc., Longmont, Colo.

[21] Appl. No.: 08/934,444

[22] Filed: Sep. 19, 1997

[51] Int. Cl.[6] ..... A61G 5/10

[52] U.S. Cl. ..... 297/440.22; 296/65.03; 297/440.2

[58] Field of Search ..... 297/440.1, 440.2, 297/440.22, 440.21; 296/65.03, 65.04; 248/503.1, 500

[56] References Cited

U.S. PATENT DOCUMENTS

| | | | |
|---|---|---|---|
| 3,158,398 | 11/1964 | Stryker | 297/333 |
| 3,258,294 | 6/1966 | Towns | 297/440.22 |
| 3,632,150 | 1/1972 | Milakovich | 297/440.22 |
| 3,915,493 | 10/1975 | Brown | 297/440.22 X |
| 3,917,312 | 11/1975 | Rodaway | 280/242 WC |
| 3,989,300 | 11/1976 | Heumann | 297/440.22 |
| 4,079,994 | 3/1978 | Kehl | 297/440.22 |
| 4,170,368 | 10/1979 | Southward et al. | 280/242 WC |
| 4,266,305 | 5/1981 | Kavaloski et al. | 4/480 |
| 4,354,791 | 10/1982 | Antonellis | 414/343 |
| 4,362,311 | 12/1982 | Bergman | 280/242 WC |
| 4,365,840 | 12/1982 | Kehl et al. | 297/440.22 X |
| 4,967,864 | 11/1990 | Boyer et al. | 180/65.1 |
| 4,997,154 | 3/1991 | Little | 248/225.31 |
| 5,443,239 | 8/1995 | Laporte | 297/440.2 X |
| 5,496,088 | 3/1996 | Stewart | 296/65.03 |
| 5,500,965 | 3/1996 | Hannagan et al. | 5/654 |
| 5,593,211 | 1/1997 | Jay et al. | 297/440.2 X |

*Primary Examiner*—Peter R. Brown
*Attorney, Agent, or Firm*—MacMillian, Sobanski & Todd, LLC

[57] ABSTRACT

A quick release seat assembly (10) including a seat (11) having a seat cushion (12) and a seat frame (14), and a frame (16), wherein a pair of front seat mounts (18) support the front of seat (11) and a pair of rear seat mounts (20) support the back of seat (11). A pair of overlapping tabs (38, 42) are associated with rear seat mounts (20) and a pair of upstanding locking pins (32) and corresponding coupling mechanisms (50) are associated with front seat mounts (18). Each coupling mechanism (50) includes a releasable latch that engages the upstanding locking pin (32) and holds seat (11) on frame (16). A common pull cord (54) jointly releases the latches in order to allow removal of the seat.

8 Claims, 9 Drawing Sheets

QUICK RELEASE SEAT

TECHNICAL FIELD

The present invention pertains to removable seat and back support assemblies and, more particularly, to a quick release mechanism for facilitating easy removal and remounting of a seat or back on a frame.

BACKGROUND ART

Current wheelchair designs often include a seat module that is detachable from the frame of the wheelchair for the purposes of transporting the wheelchair in a compact manner. U.S. Pat. No. 4,997,154 of Little discloses a quick release clamp assembly that holds hook type support brackets extending outwardly from a seat frame to a tubular frame bar of a wheelchair. With the clamp assembly in its open position, the seat frame can be removed from the wheelchair frame by lifting the seat upwardly. A common problem with such a detachable design involves the outwardly extending hook type support brackets. It can be cumbersome to maneuver these brackets between the side arm rests and adjacent wheelchair frame components, when removing and reinstalling the seat.

U.S. Pat. No. 3,917,312 of Rodaway discloses a seat frame that is detachable from a wheelchair frame. The horizontal tubes of the seat frame include downwardly extending spring type tabs that snap over the sides of the upper arms of the wheelchair frame. The front ends of the seat frame include sockets that mate with laterally spring biased tubes to hold the front end of the seat to the wheelchair frame. A pair of knobs attach to the spring biased tubes to release the tubes from their corresponding sockets, in order to release the front end of the seat frame.

U.S. Pat. No. 4,170,368 of Southward et al. discloses a wheelchair having a detachable seating unit that is held to the wheelchair support base by a rotatable locking plate. The locking plate has four arms, one at each corner of the wheelchair, that engage slots in upstanding conical projections of the support base. An external lever provides an easy mechanism for rotating the locking plate and disengaging its arms from within the slots, thus allowing removal of the seating unit.

The foregoing patents are provided for background purposes and may be considered in order to put the present invention into the proper perspective.

DISCLOSURE OF INVENTION

Briefly described, the present invention comprises a quick release mechanism for releasably securing a seat cushion and/or a back support cushion onto a frame, wherein the cushion includes a coupling mechanism. Each coupling mechanism includes a headed locking pin on the frame, a socket secured to the cushion, and a latch associated with the socket although these parts can be reversed. Also included is a restraint mechanism that in combination with the coupling mechanism secures the cushion to the frame. The restraint mechanism prevents movement of the cushion away from the frame in a direction generally perpendicular to the plane of the cushion.

The quick release mechanism is substantially identical whether used for a seat or back support cushion. For simplicity, only the seat embodiment is summarized herein.

According to an aspect of the invention, the restraint mechanism includes overlapping first and second tabs, the first tab being secured at a first end portion of the seat and the second tab being secured to the frame. The second tab overlays the first tab when the seat is mounted on the frame, so that movement of the seat in a direction perpendicular to the plane of the seat and away from the frame is prevented by engagement of the first and second tabs, but movement of the seat in a direction generally parallel to the plane of the seat releases the first tab from overlapping alignment with the second tab. This allows the first end portion of the seat to be removed from the frame. In this manner, the seat can be removed from the frame by moving the latch of each hold down mechanism to its second position, lifting one end of the seat away from the frame, and then moving the seat sideways to the frame to release the first tab from overlapping alignment with the second tab.

Preferably, the first tabs are adjustably secured to the seat in order to permit lateral adjustment of the first tabs. In addition, it is preferable that the first and second tabs be rigid members.

According to another aspect of the invention, the upper surface of each upstanding locking pin is angled so that when the seat is mounted onto the frame, engagement of each movable latch with an associated locking pin causes each latch to move from its first position to its second position, allowing the latch to pass beyond the head of the locking pin and, thus, allowing the latch to catch beneath the head in position to secure the seat on the frame.

Preferably, the movable latches are coupled to a common actuator for moving the latches together from their first positions to their second positions. In addition, it is preferable that the movable latches be pivotally mounted to move between their first and second positions and that the common actuator comprises a cord attached to an end of each latch. With this design, a pull of the cord simultaneously pivots the latches from their first to their second positions, which allows the seat to be removed from the frame.

According to another aspect of the invention, the hold down mechanisms include biasing means for biasing the latches into their first positions. In this manner, the seat can be lowered onto the locking pins and the locking pins cause the latches to pivot out of the way as they move past the headed ends of the locking pins.

According to another aspect of the invention, the seat assembly is height and angle adjustable relative to the wheelchair frame. The seat assembly includes front and back mounts on which the seat is supported and each mount is vertically adjustable. This allows, for example, the front mounts to be raised higher than the back mounts, in a manner angling the seat backwardly. Likewise, the back mounts can be raised higher than the front mounts, which angles the seat forwardly. Also, all four mounts can be raised and lowered to adjust the height of the seat relative to the frame.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
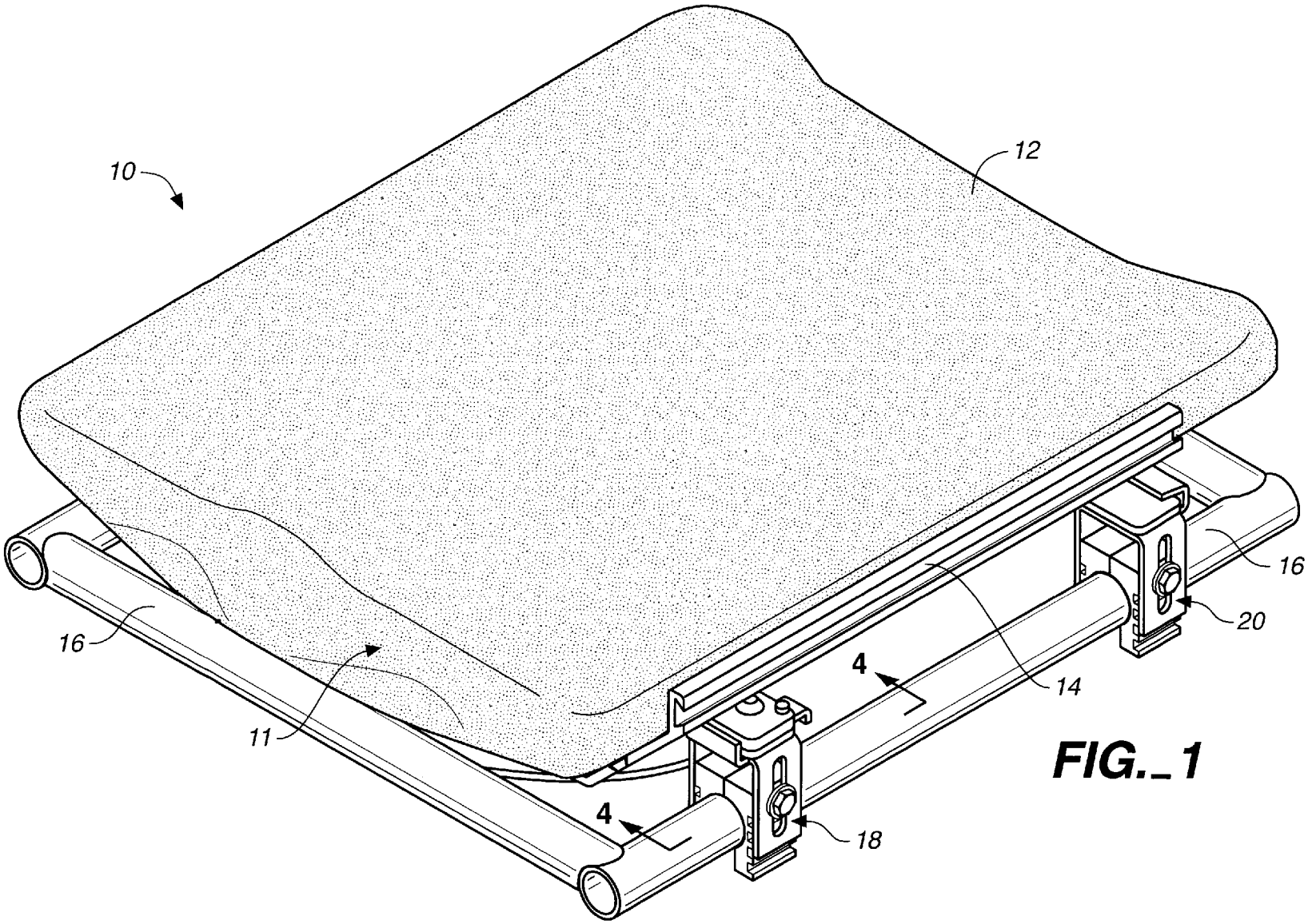
FIG. 1 is a pictorial view of the quick release seat assembly of the present invention.

FIG. 1 is a pictorial view of the quick release seat assembly 10 of the present invention. Seat assembly 10 comprises a detachable seat 11 including a seat cushion 12 and a seat frame 14, a seat assembly frame section 16 that forms part of the frame of a wheelchair (not shown), front seat mounts 18 and back seat mounts 20. Frame section 16 is shown for exemplary purposes as a rectangular frame but other frame designs can be used in combination with the detachable seat 11 — all that is necessary of frame 16 is that it provide solid structural support for the seat mounts 18, 20.

Figure 2:
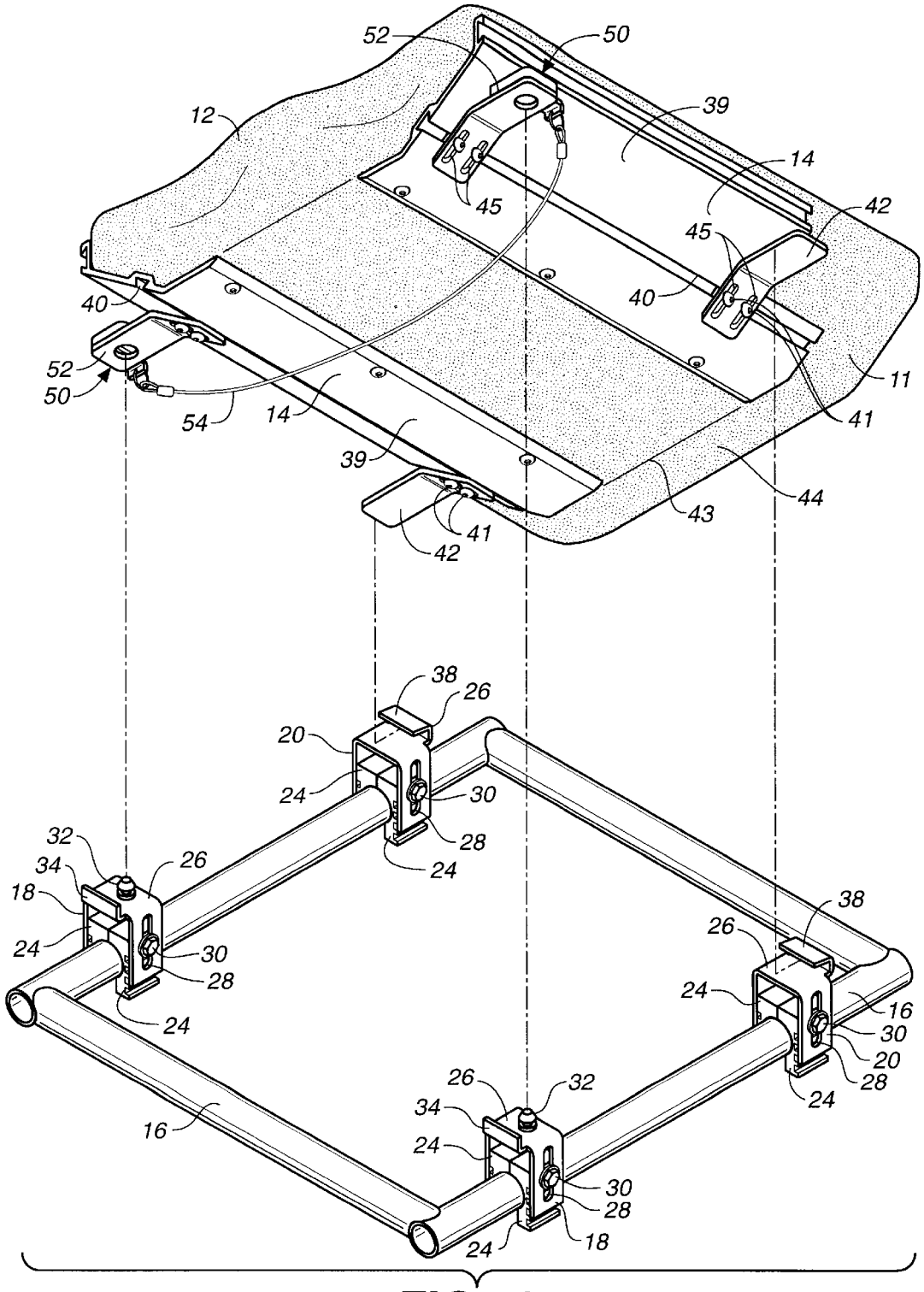
FIG. 2 is an exploded view with the seat detached from the frame.

In FIG. 2, removal of seat 11 from frame 16 shows that frame 16 supports a pair of identical front seat mounts 18 and a pair of identical back seat mounts 20. Both seat mounts 18 and 20 include a pair of opposed C-shaped clamp blocks 24 and an inverted U-shaped bracket support 26, which straddles abutting clamp blocks 24. Each bracket support 26 includes a vertical slot 28 in each of its downwardly depending legs and a corresponding adjustable mounting bolt 30, which extends through slots 28 and aligned bores in clamp blocks 24. Slots 28 and bolts 30 allow for vertical adjustment of seat 11 relative to frame 16, as discussed later.

Bracket supports 26 of front seat mounts 18 each include an upstanding, bevel-headed locking pin 32 secured to the top of bracket support 26 and a front edge guard or stop 34 formed integrally with bracket support 26. Rear seat mounts 20 each include an overlying hold down tab or rail 38, which is J-shaped and projects upwardly from the back edge of bracket support 26 and forwardly over a portion of the top of bracket support 26.

The seat frame 14 of seat 11 includes a pair of extruded side plates 39, which each include a longitudinal track 40. Side plates 39 are rigidly joined by a base plate 43, which forms the base support for the padding of seat 11 and which is preferably covered by a seat cover 44 that covers the seat cushion as well.

Seat 11 also includes a pair of angled rear feet supports 42, which are adjustably secured in tracks 40 by means of mechanical fasteners 41. Preferably, rear feet supports are rigid, non-deflectable members. Rear feet supports 42 each include a pair of aligned slots 45, which receive fasteners 41 and provide lateral and vertical adjustment of seat 11. When seat 11 is mounted onto the frame 16, rear feet supports 42 rest on the bracket mounts 26 of rear seat mounts 20, partially underneath rail 38. In this manner, feet 42 and rails 38 provide overlapping tabs that prevent vertical movement of the rear end of seat 11, but allow for forward movement of the seat relative to rear mounts 20.

Alternative designs for rails 38 and feet 42 can be provided that could prevent movement in a direction perpendicular to the wheel chair frame, i.e. perpendicular to the plane of the seat, but allow movement in a generally parallel direction of the seat, and thereby permit removal of the seat from the rear seat mounts. For example, a downwardly depending headed pin could be provided underneath the seat extrusions and an open ended, forwardly facing slot could be provided on brackets 26. Positioning of the headed pins within the open ended slots would prevent vertical movement of the seat, but the seat could be slid forwardly, with the pins sliding out the open, front end of the slots, to remove the seat. Regardless of the particular design for rear seat mounts 20, it is necessary that they function as a restraint mechanism that prevents outward movement of the seat away from the frame in a direction generally perpendicular to the plane of the seat.

Seat 11 also includes a pair of front coupling mechanisms 50, which couple the front of seat 11 to front seat mounts 18. Each coupling mechanism 50 includes an angled front foot support 52 and a common actuator cord 54, which are discussed in more detail with reference to FIGS. 3–6. Coupling mechanisms 50, rear feet supports 42, and front and rear mounts 18, 20 are examples of mounting elements that themselves are secured to the seat and to the frame and function to secure the seat to the frame in a manner preventing sufficient movement of the seat away from the frame in a direction perpendicular to the plane of the seat but allowing release of the seat by movement in a direction generally parallel with the plane of the seat. These mounting elements can be reversed, with the coupling mechanisms and the feet supports secured to the frame and the mounts secured to the seat.

Figure 3:
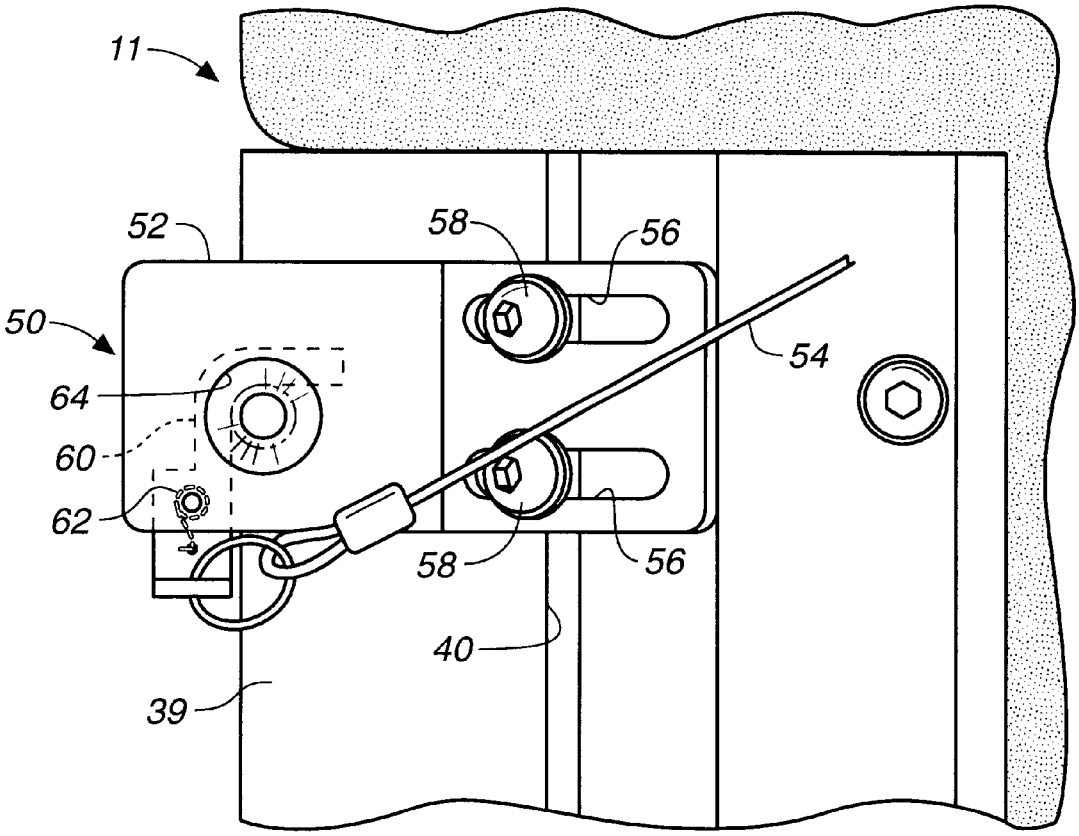
FIG. 3 is an enlarged underside view of one of the front coupling mechanisms showing the latch in an inwardly pivoted closed position.

In FIG. 3, one front coupling mechanism 50 is shown in greater detail. The angled foot support 52 of coupling mechanism 50 includes a pair of aligned slots 56 and a pair of mechanical fasteners 58. Fasteners 58 may comprise a bolt and slide combination, which slide in track 40 and can be loosened to adjustably secure foot support 52 at a selected location to the underside of side plate 39.

An L-shaped latch mechanism 60, shown partially in phantom, is pivotally attached by a pivot pin 62 to foot support 52. The underside of foot support 52 includes a circular hole 64, which is slightly wider than the locking pin of the front seat mounts. Actuator cord 54 is secured to the outer end of latch 60.

Figure 4:
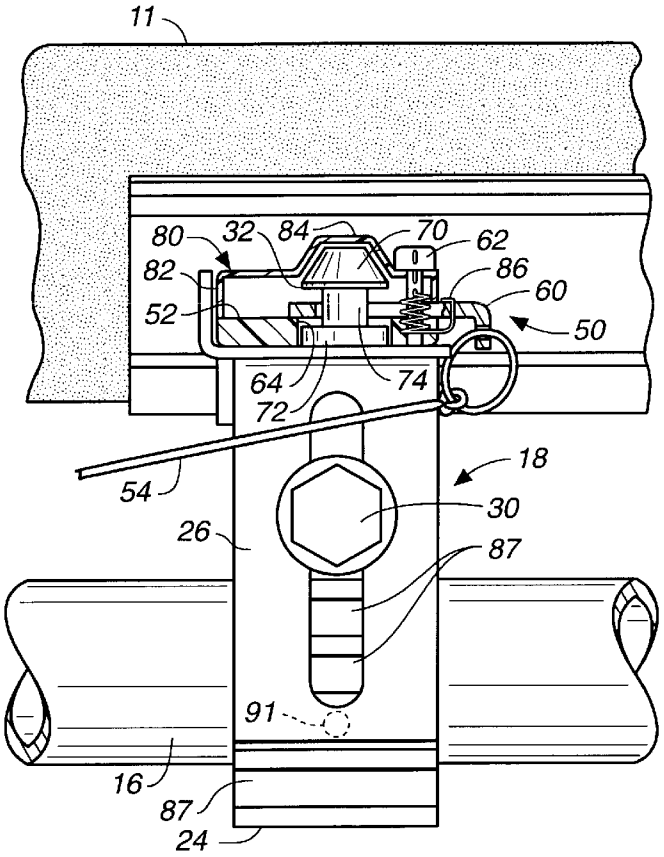
FIG. 4 is a cut away side elevation view through the coupling mechanism of FIG. 3 showing the bevel headed locking pin and socket assembly of the coupling mechanism.

In FIG. 4, locking pin 32 of front seat mount 18 is shown to include a beveled head 70, a base 72, and a neck 74. Base 72 is sized to closely fit within circular hole 64 of foot support 52 and thereby prevent excessive lateral movement of seat 11 when mounted on front seat mount 18. Latch 60 is aligned with neck 74 in a manner that creates an overlapping relationship between latch 60 and beveled head 70. As discussed with reference to FIGS. 5 and 6, latch 60 has a first, closed position, which is shown in FIG. 3, wherein latch 60 engages locking pin 32, and a second, open position wherein latch 60 is released from engagement with the locking pin. In its open position, latch 60 is pivoted away from locking pin 32 so that the latch and the beveled head do not overlap.

Coupling mechanism 50 further includes a socket assembly 80 formed by a housing 82, which encloses the outer portion of foot support 52 and thus encloses locking pin 32 when seat 11 is mounted on frame 16. Locking pin 32 is insertable into socket assembly 80 through hole 64. Housing 82 includes a beveled crown 84, which closely receives beveled head 70 and further serves to secure seat 11 on front seat mount 18. Pivot pin 62 pivotally secures latch 60 to front foot support 52. A biasing spring 86 biases latch 60 into its closed position.

Figure 5:
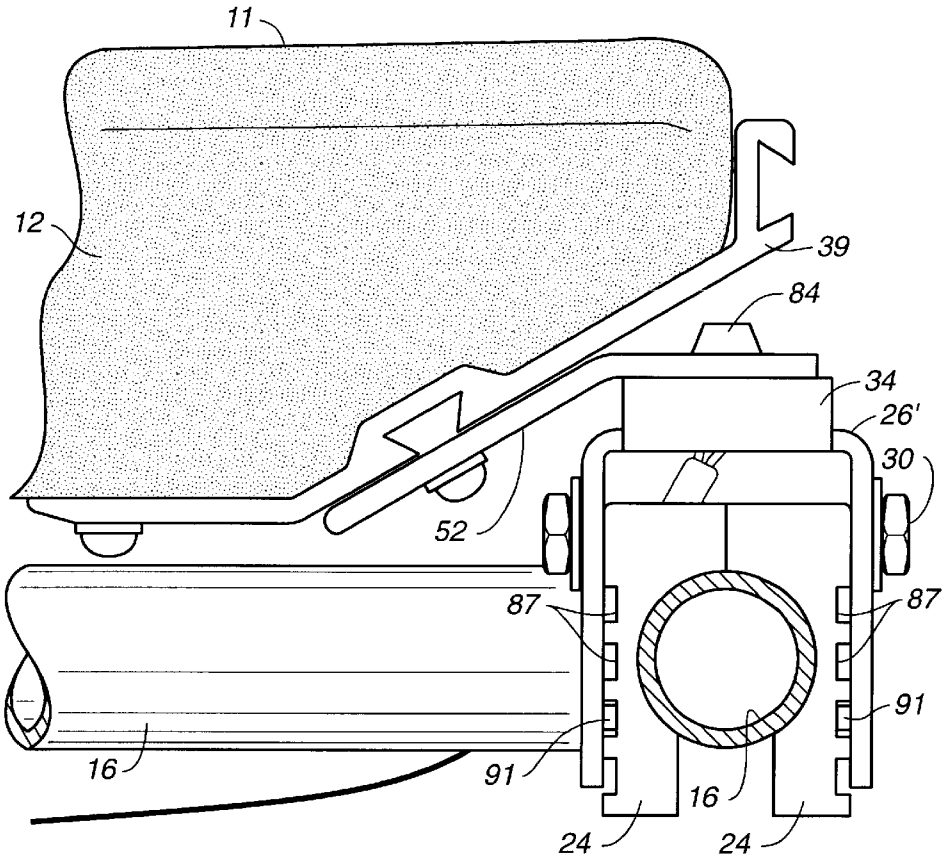
FIG. 5 front elevation view of one of the vertically adjustable front seat mounts.

In FIGS. 4 and 5, it can also be seen that clamp block 24 includes horizontal notches 87 below bolt 30. Notches 87 cooperate with inwardly projecting pins 91, one of which is provided on the inside of each downwardly depending leg of bracket 26. Pins 91 engage notches 87 at a selected indexed location, depending on the height adjustment of brackets 26. Notches 87 and pins 91 permit brackets 26 to be adjusted vertically at a desired height or distance above frame 16, in order to adjust both the height and the front to back angle of the seat, as discussed later with reference to FIGS. 9–11.

Figure 6:
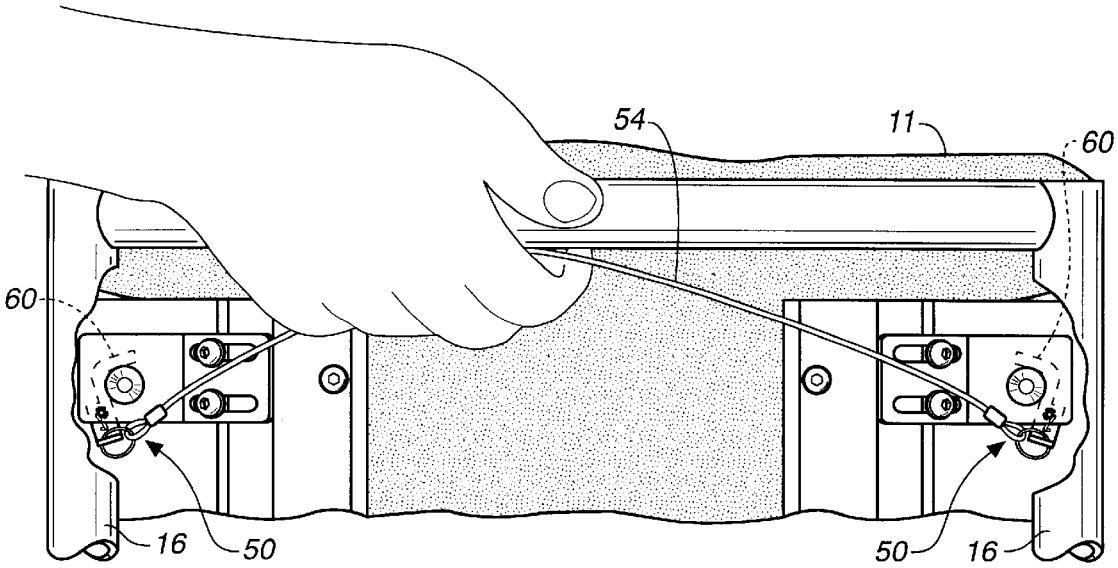
FIG. 6 is an underside view of the front end of the seat assembly showing the coupling mechanisms and their common actuator cord.
Figure 7:
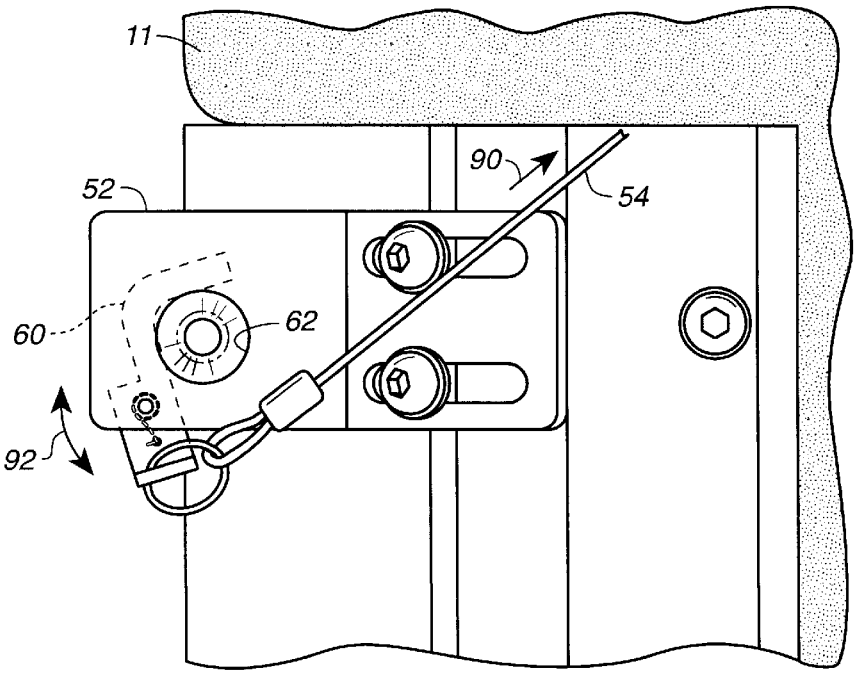
FIG. 7 is an underside view like FIG. 3 showing the latch in an outwardly pivoted released position.

Referring to FIGS. 6 and 7, actuator cord 54 is pulled in order to move latches 60 of coupling mechanisms 50 from their first, closed positions to their pivoted, open positions. In their open positions as shown, latches 60 are moved from an overlapping or overlying relationship with the beveled head of the locking pins, which allows the front end of seat 11 to be lifted from the front seat mounts. As shown in FIG. 7, a pull on cord 54 in the direction of arrow 90 pivots latch 60 in the direction of arrow 92. The diameter of hole 62 corresponds approximately with the diameter of the locking pin. Thus it can be seen that in its open position, each latch 60 is outside of the locking pin and is able to move past the beveled head of the locking pin as the seat is removed from and remounted on the front seat mounts.

Figure 8A:
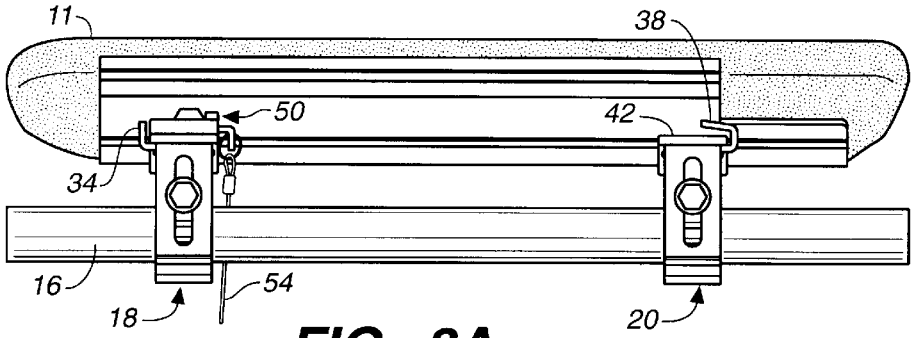
FIGS. 8A–8C are a sequence of side elevation views showing the steps for removing the seat from the frame.
Figure 8B:
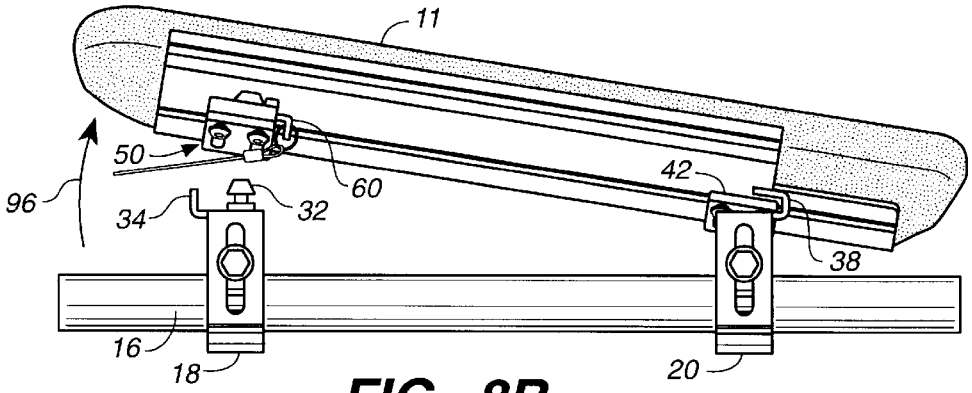
Figure 8C:
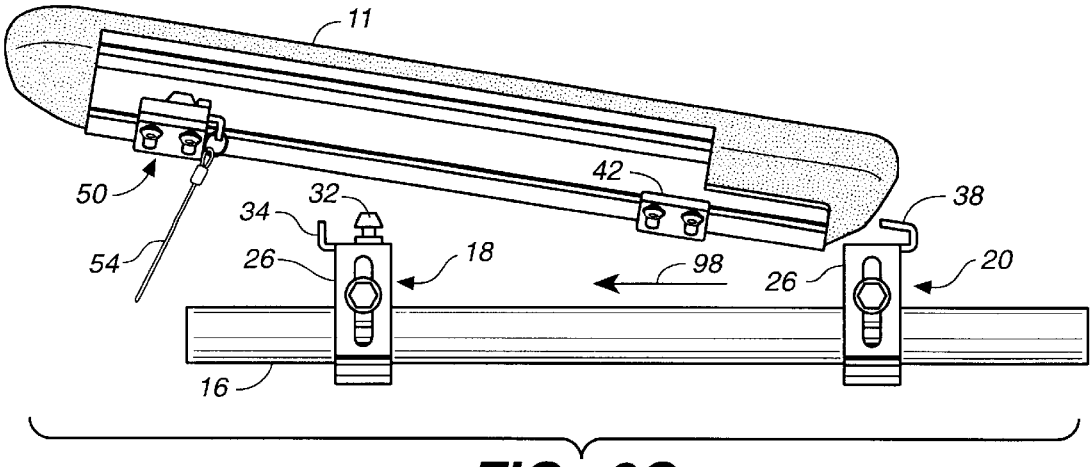

FIGS. 8A–8C illustrate the sequence of steps for removing seat 11 from frame 16. In FIG. 8A, seat 11 is mounted on front seat mounts 18 and rear seat mounts 20. In this position, rear clamp bars 38 overlie rear feet supports 42 and function to hold the rear portion of seat 11 down on rear seat mounts 20. In this manner, clamp bars 38 and rear feet supports 42 comprise overlapping first and second tabs, which overlie each other when the seat is mounted on the frame. Because of their rigid structure, engagement of the first and second tabs prevents movement of the seat in a direction perpendicular to the plane of the seat and away from the frame, but movement of the seat in a direction generally parallel to the plane of the seat releases the first tab, i.e. foot support 42, from overlapping alignment with the second tab, i.e. clamp bar 38. In this manner, the first and second tabs act as a vertical restraint mechanism preventing movement of the seat away from the frame.

The present invention may be provided with a single pair of overlapping first and second tabs, which can be positioned at the end or to one side of the seat. However, the preferred embodiment has two pairs of tabs, one at each side of the seat. It should also be noted that the rear seat mounts and the front seat mounts can be switched, as can the rear and front feet supports of the seat. This would allow the seat to be removed by first lifting the rear end of the seat.

Also, the front guards 34 of front seat mounts 18 limit forward movement of the seat, as does coupling mechanism 50. By preventing upward movement of seat 11, coupling mechanism 50 functions as a hold down mechanism. Movement of the seat in a direction perpendicular to the plane of the seat is prevented by engagement of the locking pin head and the latch. However, the coupling mechanism is not a support mechanism for seat 11. In other words, the coupling mechanism does not support the seat on the seat mounts of the frame, but merely prevents the seat from lifting off the frame without the latches being properly released.

As shown in FIG. 8B, cord 54 is pulled to release both latches 60 simultaneously or in unison from overlapping relationship with their respective locking pins, which allows the front of seat 11 to be lifted from front seat mounts 18, as shown by arrow 96. As the front of seat 11 lifts, the rear feet supports 42 tilt slightly within clamp bar 38, the top portion of which is slightly angled to accommodate such tilting.

As shown in FIG. 8C, once the front of seat 11 is lifted, the entire seat 11 can be moved forwardly or sideways as the case may be, as shown by arrow 98, in a direction generally parallel to the plane of the seat, to release rear feet supports 42 from rear seat mounts 20. Precise parallel movement may not be necessary, depending on the design of the vertical restraint mechanism. Seat 11 is remounted on seat mounts 18, 20 by reversing the process. When the seat is remounted, rear feet supports 42 are inserted underneath clamp bars 38 and front feet supports 42 are lowered onto locking pins 32. As front feet supports 42 are lowered onto locking pins 32, latches 60 engage the beveled heads of the locking pins, causing the latches to pivot to their second, open positions. When the latches move down past the beveled heads, the biasing springs move the latches into their first, closed positions beneath the beveled heads, thus securing the seat to the frame.

Figure 9:
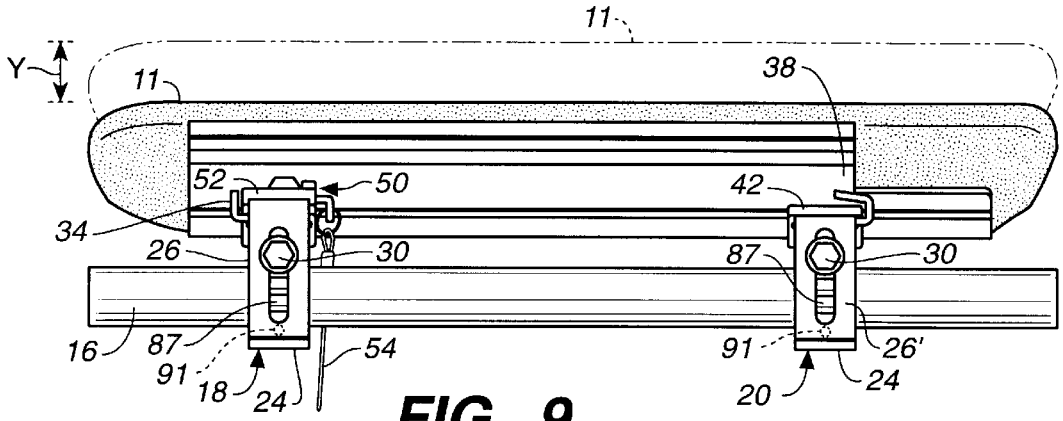
FIG. 9 is a side elevation view of the seat assembly with the seat assembly shown in solid lines in a lowered position and in phantom lines in a raised position.
Figure 10:
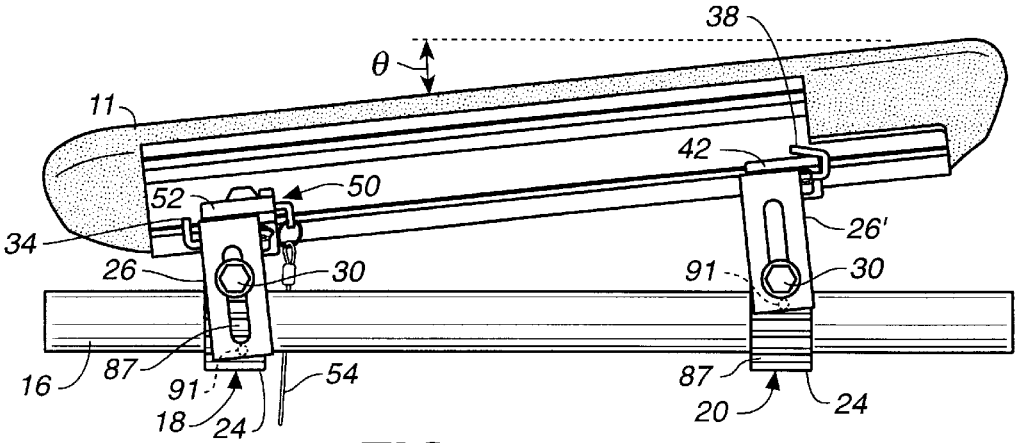
FIG. 10 is a side elevation view showing the seat assembly angled forwardly.
Figure 11:
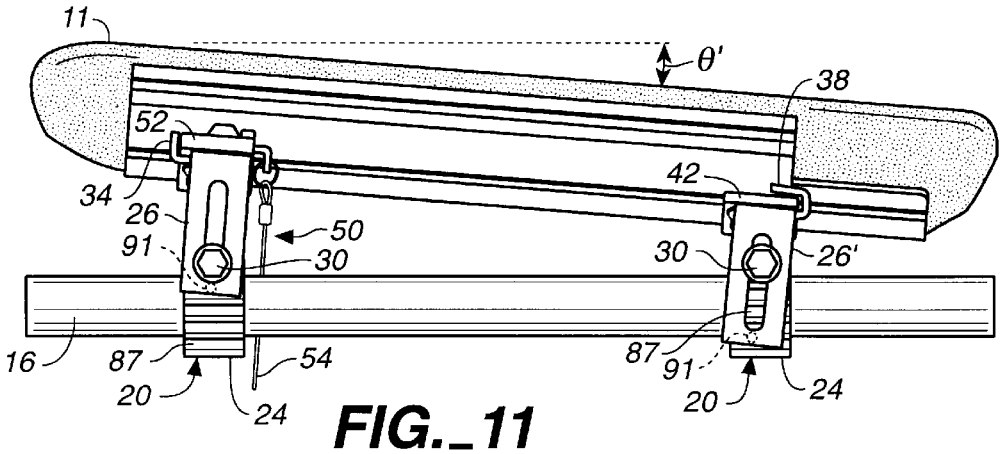
FIG. 11 is a side elevation view showing the seat assembly angled rearwardly.

FIGS. 9–11 illustrate the height and angle adjustability features of the seat cushion of the present invention. In FIG. 9, seat 11 is shown in solid lines in a lowered position. In this position, brackets 26 of both the front mounts 18 and rear mounts 20 are lowered on clamps 24, with the pin 91 in the lowest notch of each bracket 26. Seat 11 is also shown in a raised position in phantom line to illustrate the extent to which the seat can be adjusted vertically, as shown by distance Y.

FIG. 10 shows seat 11 in a forwardly angled position with rear bracket 26' raised and front bracket 26 lowered on their respective mounts. This adjustment creates an angle θ between horizontal and the top surface of the seat. When seat 11 is angled forwardly as shown in FIG. 10, each bracket support 26 pivots about bolt 30 so that it is angled slightly forwardly so that the top surface of each bracket support 26 remains flush with the underside of feet 42, 52. Pins 91 reposition slightly within their respective notches 87 when the front and back mounts 18, 20 are adjusted to angle the seat forwardly.

FIG. 11 shows seat 11 in a rearwardly angled position with front bracket 26 raised and rear bracket 26' lowered, creating a similar angle θ' between horizontal and the top surface of the seat. With the seat angled rearwardly, again, bracket mounts 26 pivot slightly to the rear to remain flush with feet 42, 52 and pins 91 reposition themselves slightly forwardly within their respective notches.

Figure 12:
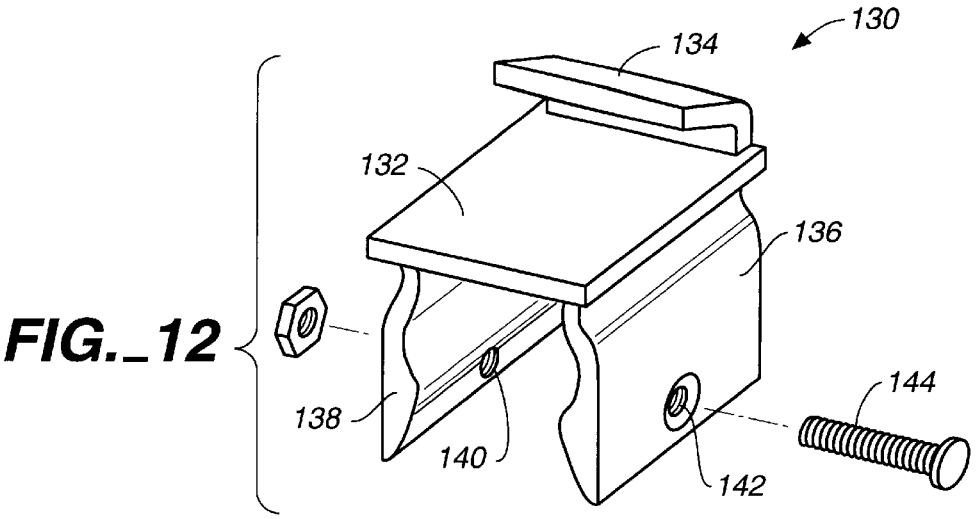
FIG. 12 is a pictorial view of an alternative embodiment for a rear seat mount that mounts the seat flush with the frame in a fixed, non-adjustable manner.
Figure 13:
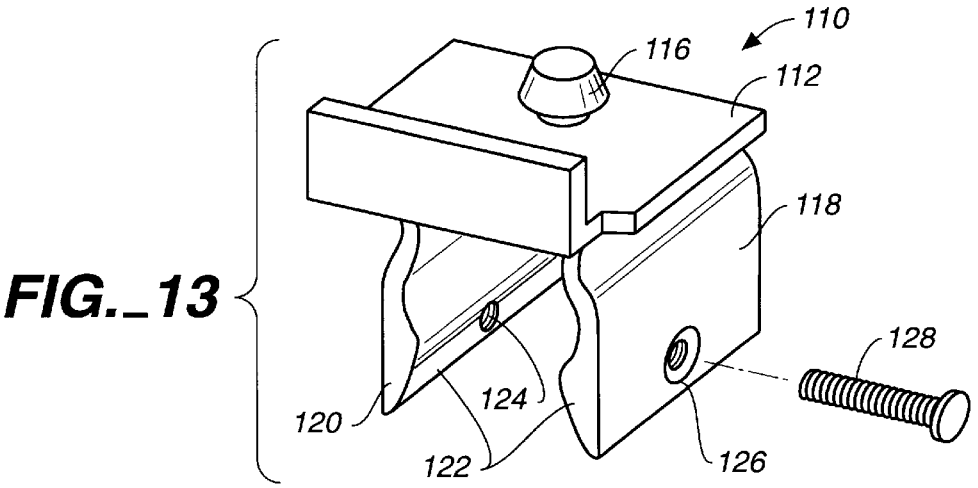
FIG. 13 is a pictorial view of an alternative embodiment for a front seat mount that, like the rear seat mount of FIG. 12, mounts the seat flush with the frame.

FIGS. 12 and 13 illustrate alternative embodiments for front and rear flush seat mounts respectively. In FIG. 13, front seat mount 110 includes a top bridge plate 112 that has a front edge guard 114 bent upwardly at its forward edge. A locking pin 116, like locking pin 32 of the first embodiment of FIGS. 1–11, projects upwardly from bridge plate 112 and functions as does locking pin 32 to capture a coupling mechanisms 50 of the seat.

A pair of downwardly extending legs 118, 120 each include curved inner surfaces 122 that are formed to allow the front seat mounts 110 to mount directly to the wheelchair frame in a non-height adjustable manner. Holes 124, 126 are formed in legs 120, 118 for receiving a clamping bolt 128.

FIG. 12 shows a similar flush mount design for a rear seat mount 130. Rear seat mount 30 includes a top plate 132 and a hold down rail 134, similar to rail 38 of the rear seat mounts of the first embodiment. Rear seat mount 130 also includes a pair of downwardly depending legs 136, 138 that are similar to legs 118, 120 of front seat mount 110. Holes 140, 142 are formed in legs 136, 138 for receiving a clamp bolt 144.

Figure 14:
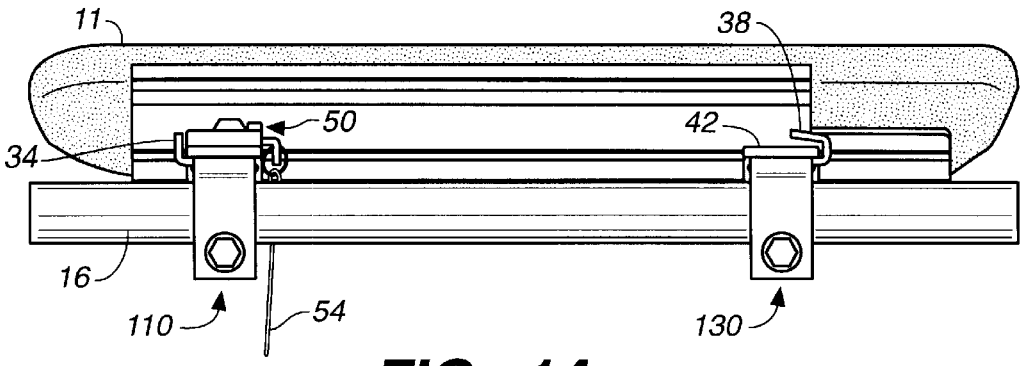
FIG. 14 is a side elevation view illustrating the flush mount alternative embodiment for securing the seat assembly to the wheelchair frame.

The flush mounts shown in FIGS. 12 and 13 permit the seat to be mounted directly to the wheelchair at a single, fixed, non-adjustable height and angle, as shown in FIG. 14. Otherwise, the flush mounts 110, 130 function the same as the height adjustable seat mounts of the first embodiment, to allow removal of the seat from the flush mounts. The height of seat 11 relative to frame 16 depends on the fixed height of the front and rear flush mounts, which can be made with different, fixed heights, depending upon customer preference.

Figure 15:
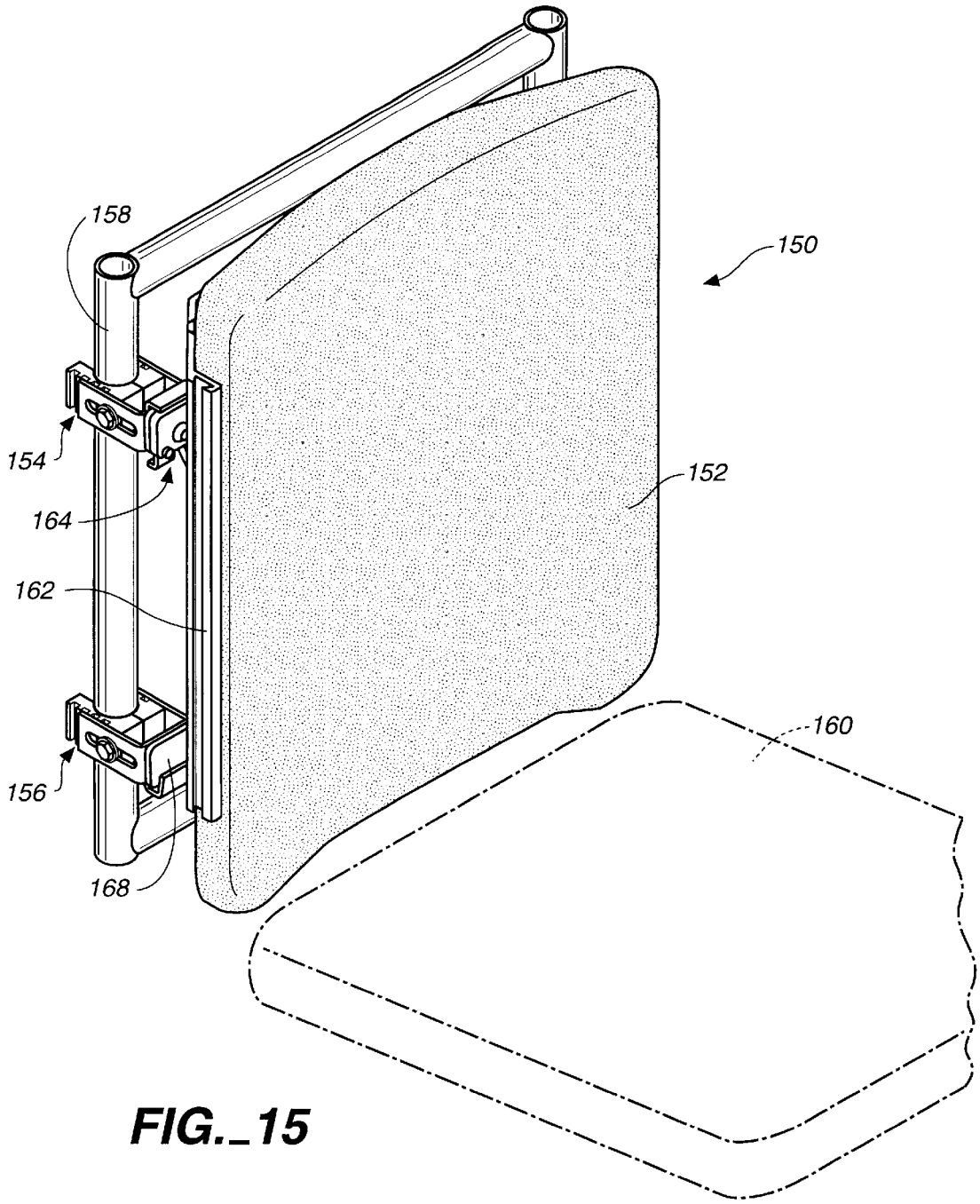
FIG. 15 is a pictorial view of a quick release back support that utilizes the quick release seat mounts illustrated in FIGS. 1–11.

Referring to FIG. 15, a quick release back support assembly 150 includes a detachable back cushion 152 and quick release back support brackets 154, 156 clamped to a wheelchair frame 158. A seat 160 is shown in phantom and may or may not be detachable as is the seat of the first embodiment. Back cushion 152 includes side plates 162 (only one shown) that are identical to the side plates 39 of the detachable seat 11 shown in FIGS. 1–8. Back cushion 152 also includes a pair of upper coupling mechanisms 164, which are the same as the coupling mechanisms 50 of the detachable seat. Likewise, outwardly extending feet 168 of back cushion 152 are captured by lower back support brackets 156 in the same manner as discussed with reference to FIGS. 8A–8C.

In essence, the quick release back support assembly 150 is designed and functions the same as the quick release seat of FIGS. 1–11. Thus, the pull cord is pulled downwardly to release the coupling mechanism, which allows the upper end of the back support to move forwardly in a direction perpendicular to the plane of the back support. Then, the lower end of the back support is raised to release the feet from the lower support brackets. Also, the height and angle adjustability of back support 150 is similar to that of the quick release seat.

The quick release mechanism described herein is equally adaptable for releasably securing both seats and seat backs, and accordingly, in the following claims, the inventor herein intends to include both applications by use of either the term "seat" and "back", unless the context clearly indicates otherwise. For example, the use of the term "seat component" is meant to include both seat cushions and seat back supports.

From the foregoing, it can be seen that the present invention provides an easily detachable seat assembly that can quickly be removed and/or remounted onto the seat mounts and which is securely held in place once mounted. The seat assembly can easily be aligned with the seat mounts in order to mount the seat assembly onto the supports, and the seat assembly can easily be coupled with the seat mounts to secure the seat assembly. In addition, the actuator cord provides an easy means for uncoupling the seat assembly prior to removal.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto when read and interpreted according to accepted legal principles such as the doctrine of equivalents and reversal of parts.

What is claimed is:

1. A quick release mechanism for releasably securing a seat assembly component to a seat assembly frame, comprising:

a restraint mechanism adapted for mounting to at least one of the frame and the component and adapted to prevent sufficient movement of the component away from the frame in a direction perpendicular to a plane of the component to release the component from the frame, the restraint mechanism being further formed for release of the component from the frame upon movement of the component in a plane generally parallel to the plane of the component; and a coupling mechanism adapted for mounting to at least one of the frame and the component, the coupling mechanism including a releasable latch for securing the component to the frame in combination with the restraint mechanism and the coupling mechanism further being adapted to prevent release of the component from the frame while in a latched condition, and being adapted for movement of the component when in an unlatched condition to release the restraint mechanism and allow release of the component from the frame, the coupling mechanism further including a headed locking pin and a socket formed to receive the locking pin, the releasable latch being movable from a first position wherein the head and latch overlie each other so that movement of the component in a direction perpendicular to the plane of the component is prevented by engagement of the head and the latch, and wherein the latch is movable to a second position away from the head so that movement of the component in a direction perpendicular to the plane of the component is not prevented by the latch.

2. The mechanism of claim 1, wherein the upper surface of each locking pin is angled so that when the component is mounted onto the frame, engagement of the movable latch with the locking pin causes each latch to move from its first position to its second position, allowing the latch to pass beyond the head of the locking pin.

3. A quick release mechanism for releasably securing a seat assembly component to a seat assembly frame, comprising:

a restraint mechanism adapted for mounting to at least one of the frame and the component and adapted to prevent sufficient movement of the component away from the frame in a direction perpendicular to a plane of the component to release the component from the frame, the restraint mechanism being further formed for release of the component from the frame upon movement of the component in a plane generally parallel to the plane of the component; and a pair of coupling mechanisms each adapted for mounting to at least one of the frame and the component, the coupling mechanisms each including a releasable latch for securing the component to the frame in combination with the restraint mechanism and the coupling mechanisms each further being adapted to prevent release of the component from the frame while in a latched condition, and being adapted for movement of the component when in an unlatched condition to release the restraint mechanism and allow release of the component from the frame, wherein the releasable latches of the first and second coupling mechanisms are coupled to a common actuator for moving the latches together from their latched conditions to their unlatched conditions, wherein the releasable latches are pivotally mounted to move between their latched and unlatched conditions and wherein the common actuator comprises a cord attached to an end of each latch, whereby a pull of the cord causes the latches to simultaneously pivot together from their latched to their unlatched condition.

4. The mechanism of claim 3, wherein each coupling mechanism includes biasing means for biasing the latch into its latched condition.

5. A quick release mechanism for releasably securing a seat assembly component to a seat assembly frame, comprising:

a restraint mechanism including:

a first pair of overlapping first and second tabs, the first tab being secured to the component and the second tab being secured to the frame, the second tab overlying the first tab when the component is mounted on the frame, so that the movement of the component in a direction perpendicular to the plane of the component and away from the frame is prevented by engagement of the first and second tabs, but movement of the component in a direction generally parallel to the plane of the component releases the first tab from overlapping alignment with the second tab, allowing the component to be removed from the frame; and a second pair of overlapping first and second tabs similar to the first pair of overlapping tabs, the first and second pairs of overlapping tabs each being positioned on opposite sides of the frame; and a pair of coupling mechanisms each adapted for mounting to at least one of the frame and the component, the coupling mechanisms each including a releasable latch for securing the component to the frame in combination with the restraint mechanism and the coupling mechanisms each further being adapted to prevent release of the component from the frame while in a latched condition, and being adapted for movement of the component when in an unlatched condition to release the restraint mechanism and allow release of the component from the frame, and wherein the coupling mechanisms are mounted adjacent the front of the seat and the pairs of overlapping tabs are mounted adjacent the rear of the seat.

6. A quick release mechanism for releasably securing a seat to a seat assembly frame, comprising:

a restraint mechanism adapted for mounting to at least one of the frame and the seat and adapted to prevent sufficient movement of the seat away from the frame in a direction perpendicular to a plane of the seat to release the seat from the frame, the restraint mechanism being further formed for release of the seat from the frame upon movement of the seat in a plane generally parallel to the plane of the seat; and a coupling mechanism adapted for mounting to at least one of the frame and the seat, the coupling mechanism including a releasable latch for securing the seat to the frame in combination with the restraint mechanism and the coupling mechanism further being adapted to prevent release of the seat from the frame while in a latched condition, and being adapted for movement of the seat when in an unlatched condition to release the restraint mechanism and allow release of the seat from the frame, and wherein the restraint mechanism and the coupling mechanism are structured and dimensioned to cooperatively engage one another so as to permit height adjustment of the seat relative to the frame.

7. A quick release seat component adapted for removable mounting to a seat assembly frame, comprising:

a seat cushion, a restraint mechanism adapted for mounting to at least one of the frame and the seat cushion and adapted to prevent sufficient movement of the seat cushion away from the frame in a direction perpendicular to a plane of the seat cushion to release the seat cushion from the frame, the restraint mechanism being further formed for release of the seat cushion from the frame upon movement of the seat cushion in a plane generally parallel to the plane of the seat cushion; and a coupling mechanism adapted for mounting to at least one of the frame and the seat cushion, the coupling mechanism including a releasable latch for securing the seat cushion to the frame in combination with the restraint mechanism and the coupling mechanism further being adapted to prevent release of the seat cushion from the frame while in a latched condition, and being adapted for movement of the seat cushion when in an unlatched condition to release the restraint mechanism and allow release of the seat cushion from the frame, wherein the coupling mechanism further includes a headed locking pin and a socket formed to receive the locking pin, the releasable latch being movable from a first position wherein the head and latch overlie each other so that movement of the seat cushion in a direction perpendicular to the plane of the seat cushion is prevented by engagement of the head and the latch, and wherein the latch is movable to a second position away from the head so that movement of the seat cushion in a direction perpendicular to the plane of the seat cushion is not prevented by the latch.

8. The mechanism of claim 7, wherein the upper surface of each locking pin is angled so that when the seat cushion is mounted onto the frame, engagement of the movable latch with the locking pin causes each latch to move from its first position to its second position, allowing the latch to pass beyond the head of the locking pin.

* * * * *